United States Patent [19]

Brady

[11] 4,271,874

[45] Jun. 9, 1981

[54] METHOD AND DEVICE FOR INTRODUCING LIQUID INTO BOAT MOTOR COOLING SYSTEMS

[76] Inventor: Darrell B. Brady, 2361 S. Redwood Rd., Salt Lake City, Utah 84119

[21] Appl. No.: 98,606

[22] Filed: Nov. 29, 1979

[51] Int. Cl.[3] ..... B65B 3/04

[52] U.S. Cl. ..... 141/1; 141/98; 141/340; 141/363

[58] Field of Search ..... 115/75, 76; 114/270; 138/32–35; 184/1 R, 106; 141/1, 98, 392, 106, 363, 364, 365, 366, 331–345, 297–300, 199–205

[56] References Cited

U.S. PATENT DOCUMENTS 1,000,150 8/1911 Byrd ..... 141/98

*Primary Examiner*—Houston S. Bell, Jr.
*Attorney, Agent, or Firm*—Mallinckrodt & Mallinckrodt

[57] ABSTRACT

A device for introducing liquid into the cooling system of boat motors having drive units with skags, cavitation plates, propellers, and water intakes, comprises a preferably contoured container adapted to fit about the lower portion of the drive unit and to extend above the cooling system water intake. Such a container fits closely about the drive unit below the water intake but loosely about the water intake and above, so that, when the container is in place about the drive unit, liquid will be sucked into the water passages of the motor. The device may be used in connection with winterizing the motor, and in such case the container will hold a sufficient amount of antifreeze to, when mixed with the water in the cooling system, adequately protect the motor against freezing. The motor is run long enough to distribute the antifreeze through the cooling system. For checking motor operation, with the boat out of water, cool water is run into the container and motor operation is continued as long as required.

12 Claims, 4 Drawing Figures

METHOD AND DEVICE FOR INTRODUCING LIQUID INTO BOAT MOTOR COOLING SYSTEMS

BACKGROUND OF THE INVENTION

1. Field

The invention is in the field of methods and devices for winterizing inboard boat motors which have stern outdrive units, and for flushing the cooling systems of such boat motors as well as flushing the cooling sytems of outboard boat motors.

2. State of the Art

There are a large number of boats in use today which have inboard motors coupled to stern outdrive units. Many of these boats are located in climates where they are stored out of water and in freezing weather during the winter. These boats usually operate in fresh water and their cooling systems circulate water from the body of water in which they are operating. The water is drawn into the cooling system from a portion of the outdrive that is normally under water. These boats present a problem in winterizing, because it is difficult to drain such motors and, when drained, the interior of the cooling system tends to rust. Moreover, moving parts, such as the water pump, tend to bind. There has been no way to economically and easily fill these cooling systems with antifreeze for winter storage.

It is also desirable in some circumstances to be able to flush the engine cooling system with a chemical flush or merely with cold water. In addition, it is sometimes desirable to be able to run a boat motor while the boat is out of the water. This is usually the case when work is being done on the motor, such as when the motor is being tuned up. In the past, small outboard motors have been placed in 50 gallon drums of cool water and run therein for a period of time. However, there has been no satisfactory way to operate larger outboard motors or inboard motors with outdrives when the boats are out of the water.

SUMMARY OF THE INVENTION

According to the invention, a liquid may be introduced into the cooling system of either an inboard boat motor having a stern outdrive unit, or an outboard motor, when the boat and motor are out of the water, by placing the device of the invention about the lower portion of the drive unit, filling it with the liquid to be introduced into the cooling system, and running the motor.

More specifically, an inboard boat motor having a stern outdrive unit may be winterized by filling the cooling system with antifreeze. This is easily done with a minimum of antifreeze waste by placing antifreeze in the device of the invention and running the boat motor to distribute the antifreeze through the cooling system.

The device is preferably a contoured container adapted to be attached to and fit about the lower portion of an outdrive unit, at least from about the cavitationplate downwardly. The container fits closely about the skag and other parts below the water intakes and fits more loosely about the water intakes and above. When in place about the outdrive and when used for winterizing, the container will hold a sufficient amount of antifreeze, usually about four gallons, so that, when mixed with the water in the cooling system, adequate protection against freezing is obtained. Most of the antifreeze is at or above the level of the water intake so it is circulated through the motor cooling system when the motor is operated. Means are provided to attach the container in place on the outdrive unit. When the container is contoured and closely fitted below the water intakes, a minimum of antifreeze is required for winterizing of the motor.

When the device is used for flushing the cooling system with a chemical flush, the chemical flush is put in the device similarly to the antifreeze. When a cool water flush is desired so that the motor may be run with the boat out of the water, cool water is placed in the device. A hose or other source of cool water is placed so that it runs into the container to continually provide a reservoir of cool water for the motor's cooling system.

THE DRAWINGS

The best mode presently contemplated for carrying out the invention is illustrated in the accompanying drawings, in which:

FIG. 1 is a view in front elevation of a contoured container;

FIG. 2, a side elevation of the container of FIG. 1;

FIG. 3, a top plan view; and

FIG. 4, a longitudinal vertical section taken along the line 4—4 of FIG. 1, with the device installed about the outdrive portion of a boat motor, which is mounted in a boat shown fragmentarily.

DETAILED DESCRIPTION OF THE ILLUSTRATED EMBODIMENT

Figure 4:
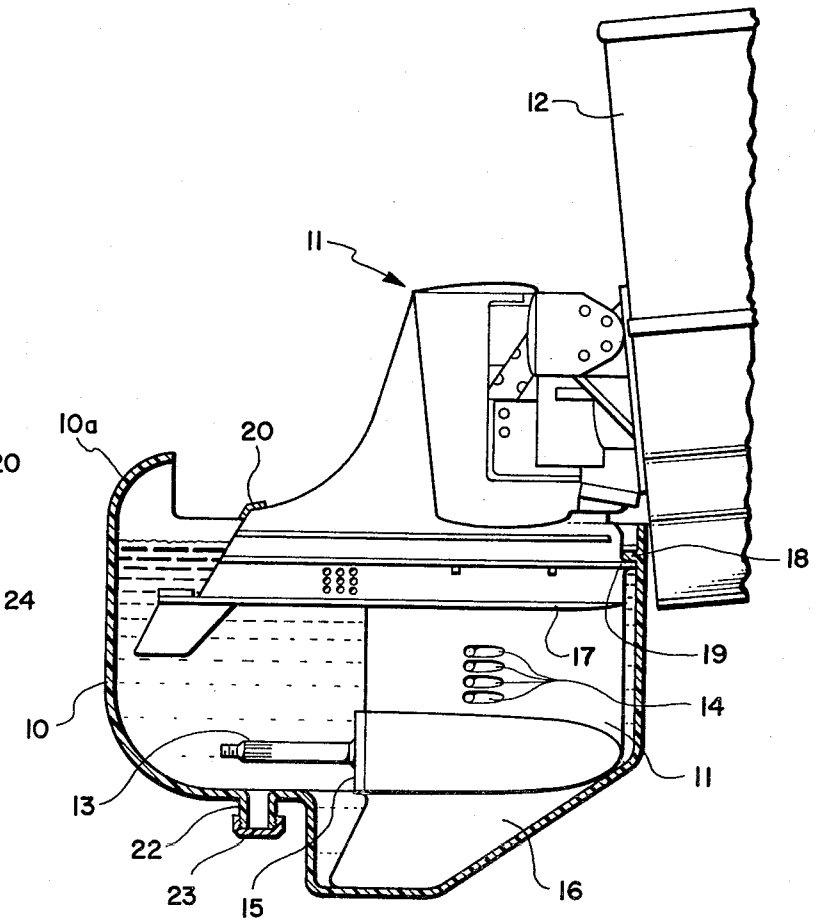
Figure 1:
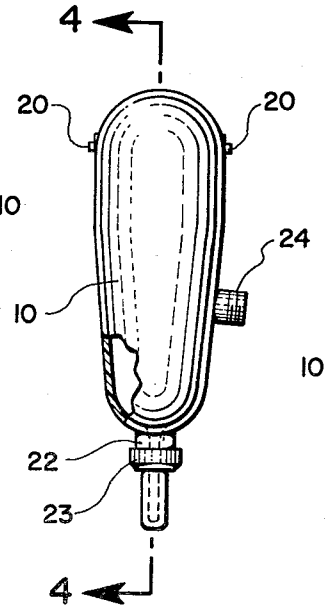
Figure 3:
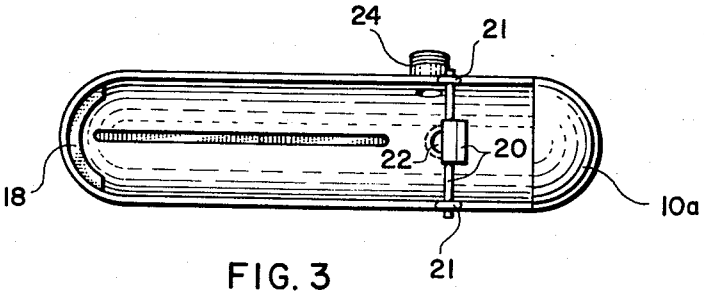
Figure 2:
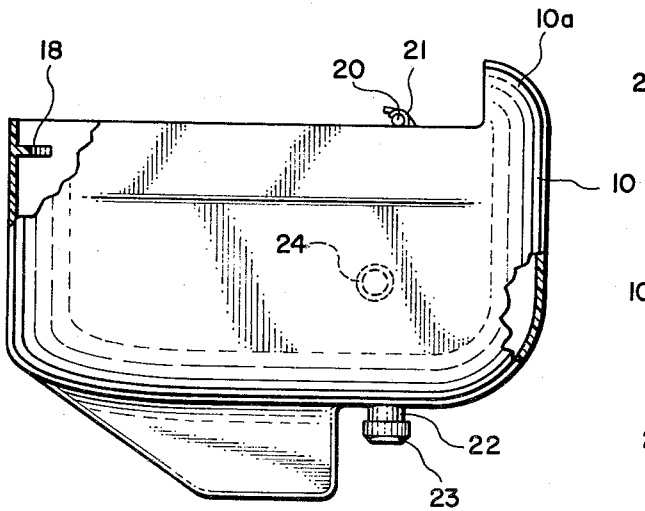

In the preferred form illustrated, a contoured container 10 is constructed for attachment to the lower portion of a stern outdrive unit 11 of a boat motor, (not shown). The motor is located inboard of a boat 12, FIG. 4, and is connected through appropriate shafts and gearing to propeller shaft 13. The cooling system of the motor is connected to the outdrive portion 11 so that cooling water is normally drawn in through water intakes 14, circulated through the motor, and discharged through water discharge ports 15 about the propeller shaft 13. The outdrive unit has a skag 16 and cavitation plate 17.

Container 10 preferably fits closely about the skag and lower portion of the outdrive unit but more loosely about the unit from just below the water intakes 14 upwardly. Container 10 extends upwardly somewhat farther than the cavitation plate as shown in FIG. 4. The height is not critical but depends upon the volume of liquid to be held and will usually extend as far as the cavitation plate to reduce spillage from the turbulence created in the container. The container is designed for use with the propeller of the unit removed in order to minimize the volume of the container.

Container 10 may be held in place by any suitable means. As illustrated, a support flange 18 rests on a ridge 19 of the outdrive unit, and a support bar 20 is secured across the top of container 10 by locks 21 so that it rests and is supported upon a portion of the outdrive unit 11.

To prepare the motor for winter, it is preferable to have a suitable mixture of antifreeze and water contained within the motor. The antifreeze mixture not only protects the motor from the harmful effects of freezing temperatures but also serves to prevent the formation of rust and to lubricate moving parts such as the water pump. The volume of water normally contained within the motor may be found by reference to the operator's manual for the particular motor being winterized, and the amount of antifreeze needed to protect the motor to the lowest expected winter temperature may be determined from the label on the antifreeze.

Container 10 is sized to hold at least the minimum amount of an antifreeze liquid required to satisfactorily protect the boat motor when such antifreeze is mixed with the water in the cooling system. For most engines, between two and six gallons of antifreeze are required to satisfactorily protect the engine. Therefore, container 10 is sized to hold between two to six gallons of liquid, most of which is held at the level of the water intakes or above.

The size of the container and its exact shape will vary somewhat depending upon the particular outdrive unit it is designed to be used with. Several models will be made, each designed to fit a particular outdrive unit. The containers are preferably molded of a high strength plastic although other materials may be used.

In winterizing a motor, the container 10 is attached as shown in FIG. 4 and a sufficient volume of antifreeze is added to give the desired concentration of antifreeze after mixing with the water in the motor. The motor is run briefly to accomplish the mixing of the antifreeze with the water, after which the device may be drained of the excess antifreeze-water mixture through drain 22 by removing drain cap 23.

Upstanding cup portion 10*a* of the container is provided to help prevent spilling of the antifreeze in the container during operation of the motor, which, because of circulation of the fluid, causes turbulence.

An important feature of the container of the invention is that it is adapted to closely fit about the lower portion of the outdrive unit so that most of the antifreeze in the container is at or above the level of the water intake. In this way, only the minimum amount of antifreeze need be used.

In addition to use for winterizing boat motors, the device may be used for flushing the system when necessary. In some instances it is desirable to flush the motor cooling system with certain cleaning, lubricating or rust preventing chemicals. In such case, the flushing chemical are placed in the container similarly as described for antifreeze and the motor run for a sufficient time to flush the system. Often it is desirable to flush the system with a coolant such as cool water so that the motor may be safely operated with the boat out of water. This allows operational adjustments to be made to the motor while it is out of the water and in a convenient location. For this purpose, the container is used as a reservoir for coolant fluid, such as cool water, and in order to provide a continuing supply of cool water, an inlet 24 is threaded and adapted to receive a garden hose. In operation, cold water flows into the device through the inlet 24 and the warmer water passes out of the drain 22 or overflows the unit. When using the drain, care must be taken to insure that the water level remains above the water intake ports 14. Drain cap 23 is normally placed over inlet 24, so that, when the container is used for winterizing the motor, it will hold antifreeze. Rather than merely a cap, a drain valve could be provided to control outflow.

Although the invention has been described with reference to an inboard motor having a stern outdrive unit, the invention may also be applied to outboard motors, particularly for flushing the motor cooling system with chemical or for flushing with coolant so that the motor may be operated out of water to make operation adjustments. Outboard motors are usually designed to drain when out of water so winterizing with antifreeze is usually not necessary.

The method of the invention for winterizing or chemical flushing purposes involves the application of a container to the water-intake portion of a boat motor unit, placing a suitable quantity of antifreeze or chemical flush within the container, and operating the motor long enough to fill the water passages of the unit with antifreeze or to satisfactorily flush the passages. For checking motor operation out-of-the-water, the method is the same except that cool water is continually added to the container and the motor is operated for as long as required.

Whereas this invention is here illustrated and described with specific reference to an embodiment thereof presently contemplated as the best mode of carrying out such invention in actual practice, it should be understood that various changes may be made in adapting the invention to different embodiments without departing from the broader inventive concepts disclosed herein and comprehended by the claims that follow.

I claim:

1. A device for introducing liquid into the cooling system of boat motors having drive units with skags, cavitation plates, propellers, an water intakes, comprising a contoured container adapted to fit about at least the lower portion of said drive unit when the propeller is removed, the lower portion of the unit extending from approximately the cavitation plate downwardly, said container closely fitting about the skag and parts below the water intake and more loosely fitting about the water intake and above so that the container, when in place about the drive unit, will hold a liquid to be introduced into the cooling system, the major portion of which liquid is at or above the level of the water intake and in communication with such intake; and means for securing the container in place on the drive unit.

2. A device according to claim 1, wherein the means for securing the container in place includes means releasably extending across the top of the container adapted to rest above and against a portion of the drive unit.

3. A device according to claim 1, wherein the boat motor concerned is an inboard boat motor installed in a boat with a stern outdrive unit extending from the boat, wherein the liquid to be introduced into the cooling system is antifreeze, and wherein the container is adapted to hold a sufficient amount of antifreeze to, when mixed with the water in the cooling system, adequately protect the motor against freezing.

4. A device according to claim 3, wherein the container has a capacity within the range of about two and six gallons of antifreeze.

5. A device according to claim 3, wherein a drain is provided in the lower portion of the container.

6. A device according to claim 1, wherein the liquid is a flushing liquid.

7. A device according to claim 6, wherein a drain is provided in the lower portion of the container.

8. A device according to claim 7, wherein an inlet for the inflow of fluid is provided in the container.

9. A device according to claim 8, wherein the inlet is threaded and adapted to receive the female end of an ordinary garden hose.

10. A method of introducing liquid into the cooling system of boat motors having drive units with skags, cavitation plates, propellers and water intakes, comprising the steps of placing a contoured container about at least the lower portion of the drive unit after the propeller has been removed, the lower portion of the unit extending from approximately the cavitation plate downwardly, the container being closely fitting about the skag and parts below the water intake and more loosely fitting about the water intake and above so that the container, when in place about the drive unit, will hold the liquid to be introduced into the cooling system; placing the liquid in the container; and running the motor for a period of time sufficient to distribute the liquid through the cooling system.

11. A method according to claim 10, wherein the boat motor concerned is an inboard boat motor installed in a boat with a stern outdrive unit extending from the boat, wherein the boat motor is to be winterized and the liquid to be introduced into the cooling system is antifreeze, wherein the container is adapted to hold a sufficient amount of antifreeze to, when mixed with the water in the cooling system, adequately protects the motor against freezing, and wherein the boat motor is run for a period of time sufficient to distribute the antifreeze through the cooling system.

12. A method according to claim 10, wherein the liquid to be introduced into the cooling system is cool water, wherein the motor is to be run for a period of time, and wherein cool water is continually added to the container during the time the motor is run.

* * * * *